US008157256B2

(12) United States Patent
Mitsuya et al.

(10) Patent No.: US 8,157,256 B2
(45) Date of Patent: Apr. 17, 2012

(54) SHEET HANDLING APPARATUS AND SHEET HANDLING METHOD

(75) Inventors: Yusuke Mitsuya, Kanagawa-ken (JP); Yoshihiko Naruoka, Kanagawa-ken (JP); Toru Todoriki, Kanagawa-ken (JP); Yukio Asari, Kanagawa-ken (JP); Naruaki Hiramitsu, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/019,589

(22) Filed: Feb. 2, 2011

(65) Prior Publication Data

US 2011/0316216 A1 Dec. 29, 2011

(30) Foreign Application Priority Data

Jun. 29, 2010 (JP) ..... 2010-148126

(51) Int. Cl.
*B65H 5/00* (2006.01)
*B65H 5/22* (2006.01)

(52) U.S. Cl. ..... 271/5; 271/4.03; 271/11; 271/10.03

(58) Field of Classification Search ..... 271/5, 6, 271/4.03, 11, 12, 10.03
See application file for complete search history.

(56) References Cited

U.S. PATENT DOCUMENTS

| | | | | |
|---|---|---|---|---|
| 4,673,175 | A * | 6/1987 | Morita | 271/10.03 |
| 5,129,641 | A * | 7/1992 | Long | 271/6 |
| 6,354,583 | B1 * | 3/2002 | Skadow et al. | 271/10.03 |
| 6,565,077 | B2 * | 5/2003 | Kawada | 271/10.03 |
| 7,270,326 | B2 * | 9/2007 | Mitsuya et al. | 271/265.04 |
| 7,416,180 | B2 * | 8/2008 | Mitsuya et al. | 271/122 |
| 7,922,168 | B2 * | 4/2011 | Schluenss | 271/10.02 |
| 2008/0296829 | A1 | 12/2008 | Asari et al. | |
| 2009/0039588 | A1 * | 2/2009 | Suzuki et al. | 271/10.03 |
| 2009/0224461 | A1 * | 9/2009 | Mitsuya et al. | 271/11 |

* cited by examiner

*Primary Examiner* — David H Bollinger
(74) *Attorney, Agent, or Firm* — Pillsbury Winthrop Shaw Pittman, LLP

(57) ABSTRACT

A sheet handling apparatus is provided that includes a take-out member to take out a sheet from a take-out position by rotating the sheet in a state in which negative pressure is applied to the sheet and the sheet is adsorbed to the take-out member. A conveyor portion receives and conveys the taken out sheet by the take-out member and a control portion controls the take-out member such that, when the sheet at the take-out position is being adsorbed to the take-out member, the take-out member is rotated at a circumferential speed that is slower than a conveying speed of the sheet at the conveyor portion. In addition, when the sheet adsorbed to the take-out member is being transferred to the conveyor portion, the take-out member is rotated at a circumferential speed that is the same as a conveying speed of the conveyor portion at that time.

20 Claims, 14 Drawing Sheets

SHEET HANDLING APPARATUS AND SHEET HANDLING METHOD

CROSS-REFERENCE TO RELATED APPLICATION

This application is based upon and claims the benefit of priority from Japanese Patent Application No. 2010-148126, filed on Jun. 29, 2010, the entire contents of which are incorporated herein by reference.

FIELD

Exemplary embodiments herein related to a sheet handling apparatus and a sheet handling method, in which stacked sheets are taken out onto a conveying path and conveyed one by one.

BACKGROUND

Conventionally, sheet handling apparatuses continuously take out and convey a plurality of stacked sheets one by one. Such a sheet handling apparatus furthermore inspects the conveyed sheets and stacks the inspected sheets in a predetermined stacking portion in accordance with the inspection result.

In this sheet handling apparatus, for example a rotating drum of a take-out portion that rotates while contacting stacked sheets, and conveyor belts of a conveyor portion that run while sandwiching the sheets that have been taken out are connected to a single driving motor via a timing belt. The take-out portion and the conveyor portion are driven while being mechanically synchronized.

Thus, even if for some reason there is a variation in the rotation speed of the driving motor, operational deviations between the take-out portion and the conveyor portion can be prevented.

Moreover, as this kind of sheet handling apparatus, a type is known in which the sheets are adsorbed to the surface of a take-out rotor and then taken out onto the conveying path. In apparatuses of this kind, negative pressure is generated at the surface of the take-out rotor and the sheets are adsorbed thereto, so that in order to reliably adsorb the sheets to the rotor surface, a method is conceivable in which the rotation speed is slowed down during the time of adsorption.

For example, if a take-out rotor of the above-described negative pressure/adsorption type is used in an apparatus in which the take-out portion and the conveyor portion are mechanically synchronized, then, if the rotation speed of the take-out rotor is slowed in order to favorably adsorb the sheets, the conveying speed of the sheets at the conveyor portion has to be made slow as well. Conversely, if the rotation speed of the take-out rotor is increased in order to increase the conveying speed at the conveyor portion, then the adsorption of the sheets becomes insufficient and take-out problems may occur.

On the other hand, the physical parameters (friction coefficients and the like) of the conveying belts may fluctuate due to various external factors such as temperature and dampness, and there may also be variations among individual belts. Furthermore, when the load acting on the conveying belts changes, also the rotation speed of the motors driving the conveying belts changes. Therefore, the conveying speed of the sheets in the conveyor portion tends to fluctuate.

When the conveying speed of the sheets fluctuates, the conveying pitch fluctuates, erroneous determinations may be made by the inspection portion, separation mistakes may occur at the separating portion, and there is the possibility that stacking mistakes occur at the stacker.

DETAILED DESCRIPTION

In general, according to one embodiment, there is provided a sheet handling apparatus, comprising a take-out member to take out a sheet from a take-out position by rotating in a state in which a negative pressure is applied to the sheet at the take-out position and the sheet is adsorbed to the take-out member; a conveyor portion to receive and convey the sheet taken out from the take-out position by the take-out member; and a control portion to control the take-out member such that, when the sheet at the take-out position is being adsorbed to the take-out member, the take-out member is rotated at a circumferential speed that is slower than a conveying speed of the sheet at the conveyor portion, and when the sheet adsorbed to the take-out member is being transferred to the conveyor portion, the take-out member is rotated at a circumferential speed that is the same as a conveying speed of the conveyor portion at that time.

Referring to the accompanying drawings, the following is a detailed explanation of embodiments.

Figure 1:
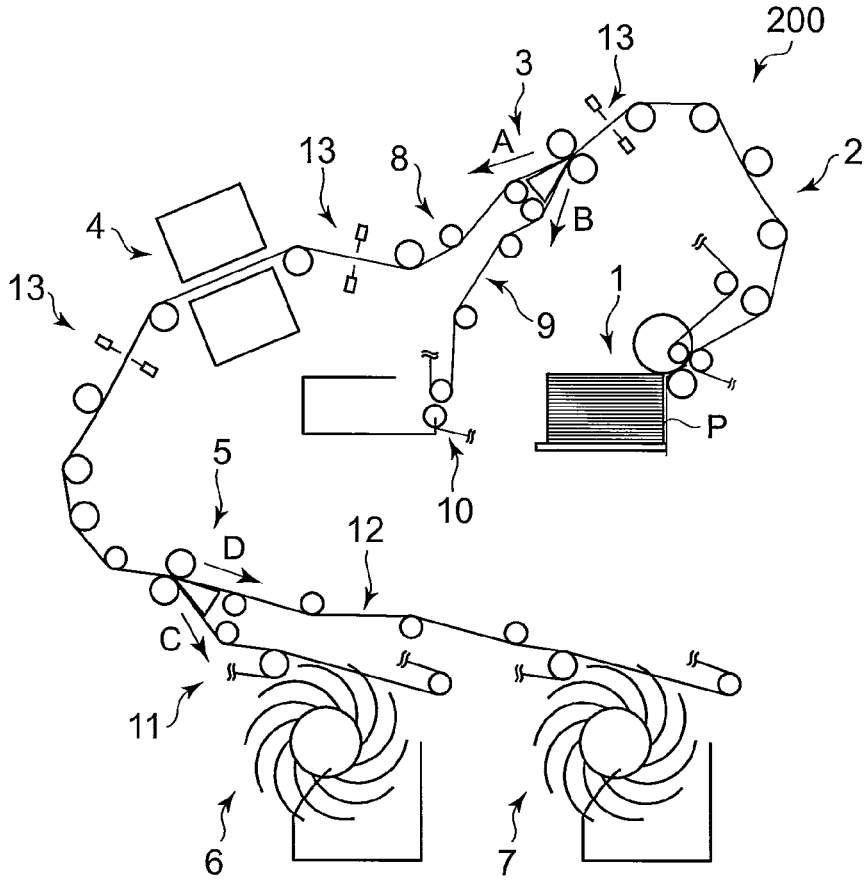
FIG. 1 is a diagrammatic view of a sheet handling apparatus in accordance with a first embodiment.

FIG. 1 is a diagrammatic view of a sheet handling apparatus 200 (also referred to simply as handling apparatus 200 in the following) in accordance with a first embodiment. The handling apparatus 200 takes out a plurality of banknotes onto a conveying path and conveys them at a constant speed, inspects the conveyed banknotes, and stacks the inspected banknotes for reuse.

The handling apparatus 200 includes a take-out portion 1, which takes out a plurality of sheets P, which are stacked in vertical direction, one by one from the uppermost sheet onto a conveying path, a conveyor portion 2, which receives the sheets P that have been taken out with the take-out portion 1 and conveys them on the conveying path, a first gate 3, which divides the conveying direction of the sheets into two directions, depending on whether the sheet P has been taken out correctly by the take-out portion 1, an inspection portion 4, which reads and inspects information from the sheets P that have been taken out correctly, a second gate 5 that divides the sheets P into two directions in accordance with the inspection result at the inspection portion 4, and a first sheet stacker 6 and a second sheet stacker 7 that stack the sheets P that have been divided (sorted) by the second gate 5.

To handle the sheets P with the handling apparatus 200, first of all, a plurality of sheets P are set in the take-out portion 1 in a stacked state as shown in the figures. Then, a plurality of sheets P are taken out in order one by one from the uppermost sheet by the take-out portion 1. The sheets P that have been taken out are received by the conveyor portion 2, and are conveyed at a constant speed by the conveyor portion 2.

The sheets P that have been correctly taken out by the take-out portion 1 are separated by the first gate 3 and conveyed in the arrow direction A in FIG. 1, and conveyed via a first branched conveying path 8 towards the inspection portion 4. On the other hand, the sheets P that have been taken out by the take-out portion 1 and for which a problem (such as a double take-out) has occurred, are separated by the first gate 3 and conveyed in the arrow direction B in FIG. 1, and conveyed via a second branched conveying path 9 towards a rejection sheet stacker 10.

After reading information and inspection with the inspection portion 4, the sheets P that have been separated and conveyed in the arrow direction A are separated by the second gate 5 in accordance with the inspection result and conveyed either in the arrow direction C or the arrow direction D in FIG. 1. The sheets P that have been separated and conveyed in the arrow direction C are conveyed via a third branched conveying path 11 to the first sheet stacker 6 and are again stacked. Moreover, the sheets P that are separated and conveyed in the arrow direction D are conveyed via a fourth branched conveying path 12 to the second sheet stacker 7 for rejection and are again stacked.

It should be noted that the conveyor portion 2 is provided with a plurality of detecting sensors 13 that are spaced apart from each other along the conveying direction of the sheets P, and the number of sheets P passing or the length of the sheets P in the conveying direction is measured by a control portion not shown in the drawings. The detecting sensors 13 each include a light-emitting portion and a light-receiving portion that are arranged flanking the conveyor portion, and the leading edge and the trailing edge of the sheets P are detected as the sheets P block the light path in which the light directed from the light-emitting portion to the light-receiving portion traverses the conveying path.

Figure 2:
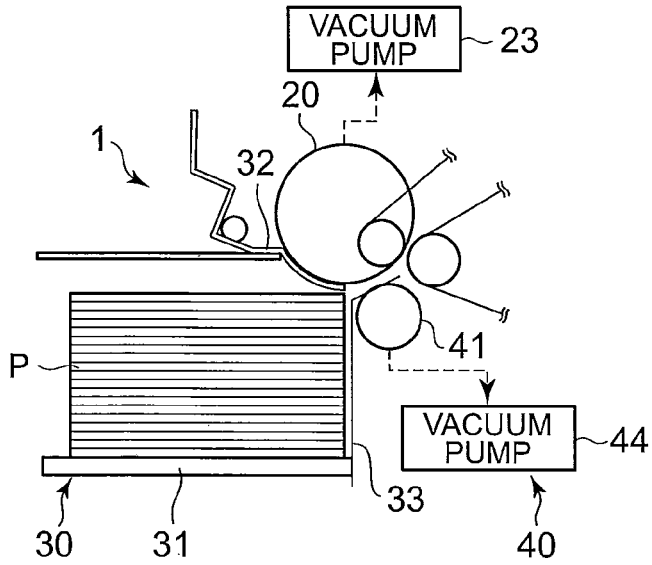
FIG. 2 is a diagrammatic view showing, in magnification, a take-out portion integrated into the sheet handling apparatus shown in FIG. 1.
Figure 3:
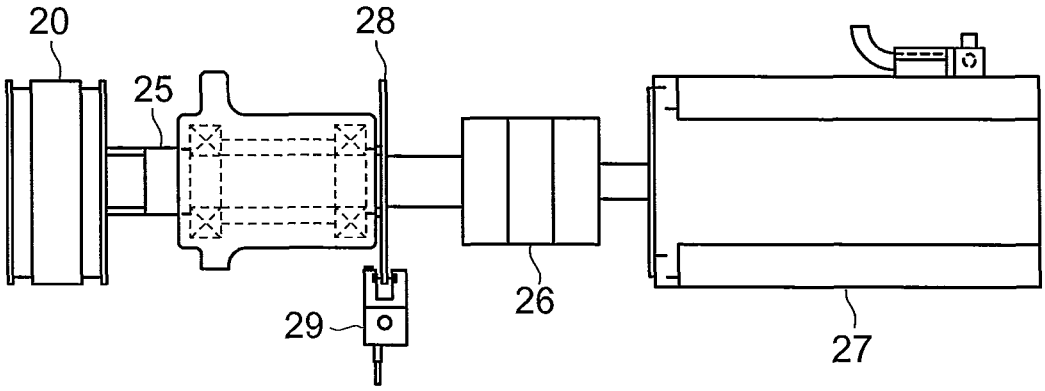
FIG. 3 shows a lateral view of a driving mechanism for driving a take-out rotor of the take-out portion in FIG. 2.
Figure 4:
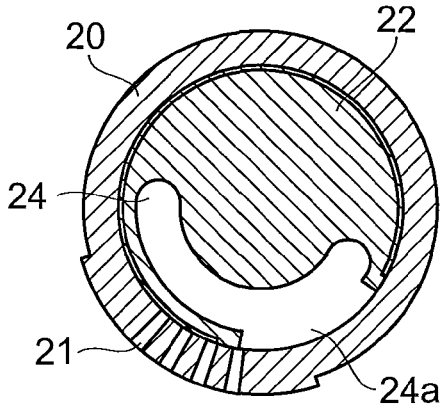
FIG. 4 shows a cross-sectional view of the take-out rotor shown FIG. 3.

FIG. 2 is a diagrammatic view showing, in magnification, the take-out portion 1 integrated into the handling apparatus 200 shown in FIG. 1. Furthermore, FIG. 3 shows a lateral view of a driving mechanism for driving a take-out rotor 20, with which the take-out portion 1 in FIG. 2 is provided. FIG. 4 shows a cross-sectional view of the take-out rotor 20 of FIG. 2. The following is a more detailed explanation of the take-out portion 1.

The take-out portion 1 includes the take-out rotor 20 (take-out member) for taking out the plurality of stacked sheets P one by one from the uppermost sheet, a supply portion 30, which lifts the plurality of stacked sheets P towards the take-out rotor 20, and a separation portion 40, which prevents double take-outs of sheets P, when the sheets P are taken out by the take-out rotor 20.

The take-out rotor 20 is formed in a substantially circularly tubular sleeve shape and is attached rotatably to the outer side of a substantially circular cylinder-shaped core member 22. The take-out rotor 20 includes a plurality of adsorbing holes 21 that connect the inner circumference with the outer circumference of the take-out rotor 20.

As shown in FIG. 4, the plurality of adsorbing holes 21 are formed close together at one location along the rotation direction of the take-out rotor 20. In other words, the plurality of adsorbing holes 21 of the take-out rotor 20 are not provided uniformly at equal spacing along the rotation direction of the roller over the entire circumference like the plurality of adsorbing holes 42 of the later-explained separation roller 41 (see FIG. 5), but are provided close together as a group of holes at one location along the entire circumference of the rotor 20. In the present embodiment, the group of adsorbing holes 21 is provided only at one location (or region) along the entire circumference of the take-out rotor 20.

On the other hand, the core member 22 includes a chamber 24 that is in communication with the plurality of adsorbing holes 21. A vacuum pump 23 is connected to this chamber 24, and a negative pressure is maintained inside the chamber 24. The chamber 24 is provided with a cutout portion **24*a* that opens its inside to the outside. The core member 22 is fixed in an orientation in which the cutout portion 24*a*** opposes the upper side of the front edge in take-out direction of the uppermost of the stacked sheets P.

When the take-out rotor 20 rotates with respect to the core member 22, the plurality of adsorbing holes 21 pass the cutout portion **24*a* of the chamber 24 during the rotation, and air is drawn in through the plurality of adsorbing holes 21 into the chamber 24. Thus, the sheet P is adsorbed to the outer circumferential surface of the take-out rotor 20, and the sheet P is taken out from the take-out position due to the rotation of the take-out rotor 20**.

The length of the cutout portion **24*a* along the rotation direction of the take-out rotor 20 is set to a length at which during the rotation of the take-out rotor 20 all adsorbing holes 21 can be simultaneously in communication with the chamber 24. Since the take-out rotor 20** of this embodiment is made of metal, rubber chips (not shown in the figures) may be adsorbed to its outer circumferential surface, in order to increase the friction coefficient between its outer circumferential surface and the paper sheets P.

As shown in FIG. 3, a servomotor 27 is coaxially attached via a coupling 26 to a shaft 25 connected to the take-out rotor 20. The take-out rotor 20 is rotated by driving this servomotor 27. Moreover, a shield plate 28 is installed to the take-out rotor 20 in such a manner that the position of the adsorbing holes 21 can be detected. The position of the adsorbing holes 21 can be detected by blocking the optical axis of a detecting sensor 29 with this shield plate 28. The detecting sensor 29 is arranged at a position where the optical axis of the detecting sensor 29 is blocked by the shield plate 28 when all adsorbing holes 21 overlap the cutout portion 24*a* of the chamber 24. That is to say, when the optical axis of the detecting sensor 29 is blocked by the shield plate 28, the largest negative pressure occurs at the surface of the take-out rotor 20, and the sheet P is adsorbed and taken out. The signal from the detecting sensor 29 is sent to a controller 100, which is explained further below.

The supply portion 30 is provided with a supply table 31 serving as a placement means, which can be raised and lowered. The sheets P are stacked on this supply table 31. The supply table 31 is moved up and down by a timing belt mechanism (not shown in the drawings) or the like, which is rotatively driven by a motor. A detecting lever 32 for detecting the upper end position of the sheets P is provided above the supply portion 30. The detecting lever 32 converts the upper end position of the sheets P into an electrical signal, and transmits this positional information to the controller 100. Based on this positional information, the controller 100 raises the supply table 31, and stops the supply table 31 immediately before the sheet P of the stacked sheets P that is at the upper end in the stacking direction contacts the take-out rotor 20.

A guide plate 33 extending in a vertical direction is fixedly provided in front of the supply table 31 (to the right in the figures), along the take-out direction of the sheets P. The guide plate 33 has the function of aligning the front end in take-out direction of the stacked sheets P, and the function of guiding the lower surface side of the sheets P, and when the sheets P are taken out in the rotation direction of the take-out rotor 20, straightens out the orientation of the paper sheets P that are taken out, before they are passed on to the conveyor portion 2.

The separation portion 40 is arranged below the take-out rotor 20 in the figures, on the rear side (right side in the figures) of the guide plate 33. The separation portion 40 is provided with a separation roller 41 that prevents double take-outs of sheets P. The separation roller 41 is rotated in a direction impeding the taking out of the sheets P (the direction opposite to the direction in which the take-out rotor 20 takes out the sheets P), by a driving mechanism not shown in the drawings. To prevent that a plurality of sheets P are fed at the same time onto the conveying path by the take-out rotor 20, the separation roller 41 adsorbs the sheets P that are not adsorbed to the take-out rotor 20 and returns them in the direction opposite to the take-out direction.

Figure 5:
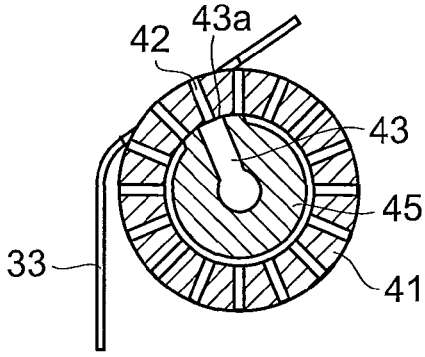
FIG. 5 is a cross-sectional view of a separation roller provided in the separation portion shown FIG. 2.

FIG. 5 is a cross-sectional view of the separation roller 41 provided in the separation portion 40 of FIG. 2. The separation roller 41 is of circularly tubular shape, and includes a plurality of adsorbing holes 42 that connect its inner circumference with its outer circumference. As noted above, the adsorbing holes 42 of the separation roller 41 are provided uniformly at equal spacing along the entire circumference of the roller. In other words, the separation roller 41 can apply a negative pressure on the sheets P at any position of its surface.

The separation roller 41 is rotatably attached to the outer side of a core member 45 of substantially circular tube shape, which includes a chamber 43. The inside of the chamber 43 is evacuated with a vacuum pump 44 (shown in FIG. 2), maintaining a negative pressure. The core member 45 is fixed at an orientation at which an opening 43*a* of the chamber 43 opposes the take-out rotor 20.

When the separation roller 41 rotates around the core member 45, the plurality of adsorbing holes 42 pass the opening 43*a* of the chamber 43 one after the other, and air is sucked into the chamber 43 through the adsorbing holes 42. Thus, a negative pressure is generated at the outer circumferential surface of the separation roller 41, and the sheet P is adsorbed to the outer circumferential surface. The separation roller 41 rotates in the direction opposite to the take-out rotor 20, and the sheets P adhering to the separation roller 41 are separated by being returned in a direction opposite to the take-out direction.

Figure 6:
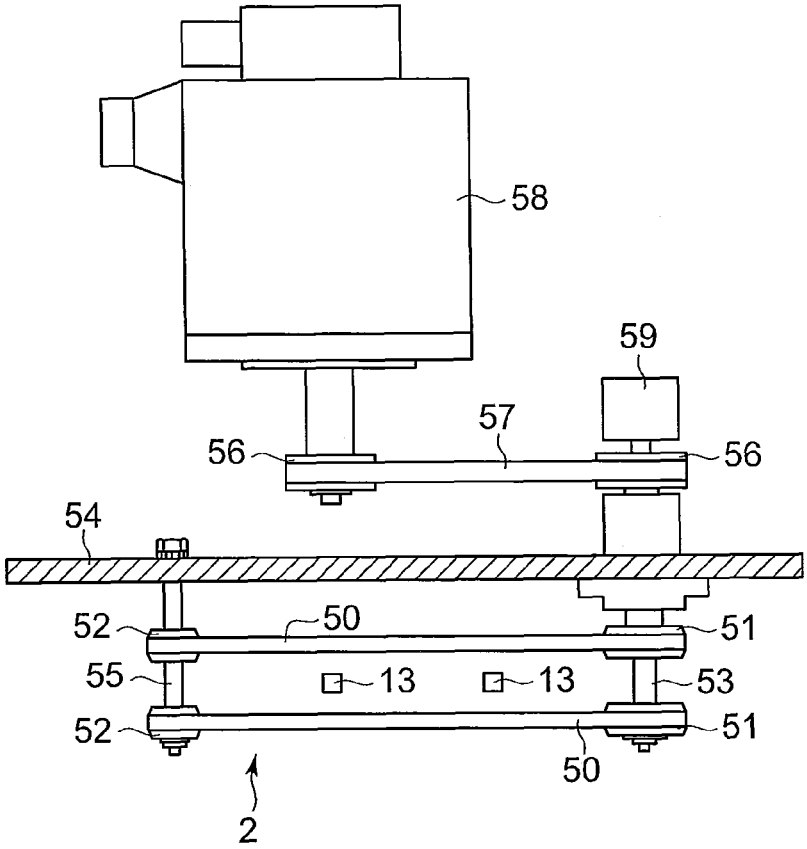
FIG. 6 is a diagrammatic view showing the structure of a part of the conveyor portion of the sheet handling apparatus shown in FIG. 1.
Figure 7:
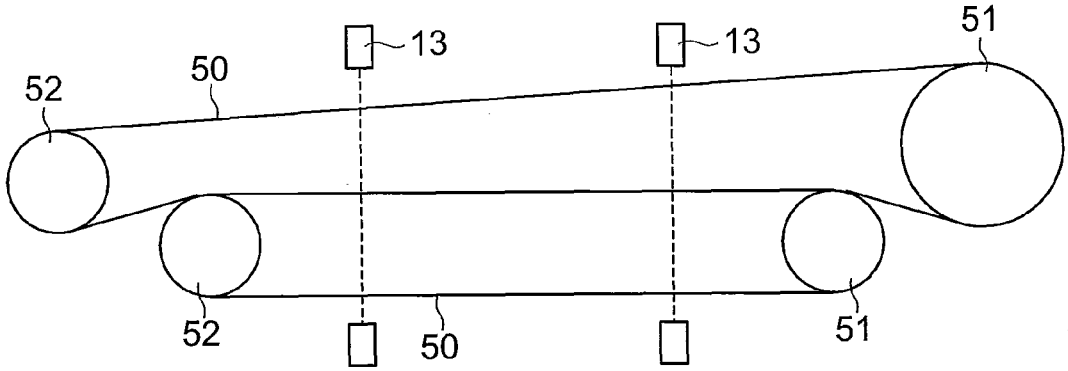
FIG. 7 is a front view showing a part of the conveyor portion shown in FIG. 6.

FIG. 6 is a diagrammatic view showing the structure of a part of the conveyor portion 2 of the handling apparatus 200 in FIG. 1. FIG. 7 is a front view of the structure shown in FIG. 6. The conveyor portion 2 has a structure in which a plurality of the structures of the parts explained here are connected in the conveying direction of the sheets P, but here the structure of only one part is explained as a representative example.

As shown in FIG. 7, the conveyor portion 2 includes a structure in which two endless conveyor belts 50 contact each other, a conveying path being formed between them. More specifically, two conveyor belts 50 are placed on one side of the conveying path, and these two conveyor belts 50 are arranged parallel to each other at a distance in the width direction, which is transverse to the conveying direction of the sheets P, as shown in FIG. 6. Also on the other side of the conveying path, two conveyor belts 50 are placed that run while respectively being in contact with the two conveyor belts 50 on the one side of the conveying path through the conveying path, as shown in FIG. 7.

The conveyor belts 50 are each suspended between a drive pulley 51 and a driven pulley 52, and the conveyed sheets P are held between the pairs of conveyor belts that run while being in contact with each other.

The drive pulleys 51 are connected to a shaft 53. The driven pulleys 52 are rotatably attached to a shaft 55 that is attached to a base 54. The shaft 53 passes through the base 54 and extends to the opposite side, and is connected to a timing pulley 56 at the opposite side of the base 54. This timing pulley 56 is connected to a conveyor motor 58 via a timing belt 57. Thus, by driving the conveyor motor 58, the drive pulleys 51 are rotated, and the conveyor belts 50 are caused to run.

Moreover, a rotary encoder 59 is connected via the shaft 53 to the drive pulley 51, and the controller 100 detects the rotation speed of the drive pulley 51 via this encoder 59. It should be noted that in this embodiment, a rotary encoder 59 is used as a detection means, but it is also possible to employ a structure in which the rotation speed is detected using a plate with slits and an optical sensor.

When the conveyor motor 58 is rotatively driven, its driving force is transmitted via the timing pulley 56, the timing belt 57 and the shaft 53 to the drive pulleys 51, and causes the conveyor belts 50 to run. Then, the sheets P taken out with the take-out portion 1 are conveyed while being held between the conveyor belts 50. The conveying speed at this time can be calculated from the rotation speed information of the drive pulleys 51 that is obtained with the encoder 59. It is also possible to calculate the conveying speed of the sheets P from the time that the sheets P need to pass detecting sensors 13 that detect the presence of sheets P at positions that are spaced apart by a predetermined distance.

The take-out portion 1 with the above-described structure takes out the plurality of sheets P onto the conveying path one by one through the following operation. First, the supply table 31 is raised, and the uppermost of the plurality of sheets P that are stacked on the supply table 31 presses the detecting lever 32 upward. The detecting lever 32 sends its rotation angle signal to the controller 100. Based on the rotation angle information from the detecting lever 32, the controller 100 judges that the uppermost sheet P has been raised to the point immediately before it contacts the outer circumferential surface of the take-out rotor 20, and the supply table 31 is stopped in this position.

When the uppermost sheet P is thus raised to the take-out position, the vacuum pump 23 is operated, the inside of the chamber 24 of the take-out rotor 20 is maintained at negative pressure, and the take-out rotor 20 is rotated in the counter-clockwise direction in the figure by the servomotor 27. Then, when the adsorbing holes 21 of the take-out rotor 20 are opposed to the cutout portion 24*a* of the chamber 24 and connected thereto, air is drawn in from the adsorbing holes 21 by the negative pressure inside the chamber 24, and the uppermost sheet P is adsorbed to the outer circumferential surface of the take-out rotor 20. The adsorbed sheet P is taken out from the take-out position towards the conveyor portion 2 by the rotation of the take-out rotor 20.

After the sheet P is transferred (passed on) to the conveyor portion 2, when the take-out rotor 20 is rotated further, the plurality of adsorbing holes 21 pass the cutout portion 24*a* of the chamber 24, and the negative pressure that was generated at the outer circumferential surface of the take-out rotor 20 is removed. Thus, the adsorbing force of the take-out rotor 20 with respect to the sheet P is removed, and the sheet P is thereafter restrained and conveyed by the conveyor portion 2.

On the other hand, when a sheet P is taken out by the take-out rotor 20, the separation roller 41 rotates in the direction opposite to the take-out direction of the sheet P, a negative pressure is applied by the operation of the vacuum pump 44, and air is drawn in from the adsorbing holes 42, so that the sheet P is adsorbed. Thus, even when two sheets P are taken out at the same time by the take-out rotor 20, the second and further sheets P on the lower side is fed in the opposite direction and separated, so that only the uppermost sheet P is taken out onto the conveying path.

With the above-described operation, a plurality of sheets P are consecutively separated in this manner and taken out one by one onto the conveyor portion 2, and the sheets P that have been taken out are conveyed and handled by the conveyor portion 2. It should be noted that in this embodiment, a group of adsorbing holes 21 is provided only in one location in rotation direction of the rotor 20, so that one sheet P is taken out onto the conveyor portion 2 each time that the take-out rotor 20 performs one rotation, but it is also possible to increase the diameter of the rotor 20 and provide groups of holes at a plurality of locations in the rotation direction. In this case, a plurality of sheets P are taken out each time the take-out rotor 20 rotates once.

Now, if the take-out portion 1 and the conveyor portion 2 are driven separately, as in the handling apparatus 200 of the present embodiment, then it is necessary to match the take-out speed of the sheets P in the take-out portion 1 to the conveying speed of the sheets P in the conveyor portion 2. At least in the moment in which the sheets P are transferred from the take-out portion 1 to the conveyor portion 2, it is necessary to match the feed speed of the sheets P of the take-out portion 1 to the conveying speed in the conveyor portion 2. If these two speeds are different, then there is the risk that problems occur such as that the sheets P buckle or are ripped.

However, if a method is employed in which a sheet P that is stopped at the take-out position is taken out while being adsorbed to the outer circumferential surface (adsorbing surface) of the rotating take-out rotor 20, as in the handling apparatus 200 of the present embodiment, then the adsorbing force with respect to the sheet P may be insufficient when adsorbing the sheet P while the take-out rotor 20 is rotated at high speed, so that the take-out may be unsuccessful. On the other hand, it is desirable to make the take-out speed of the sheet P at the take-out portion 1 and the conveying speed of the sheet P at the conveyor portion 2 as fast as possible, in order to increase the throughput (handling speed) of the overall handling apparatus 200.

Figure 8:
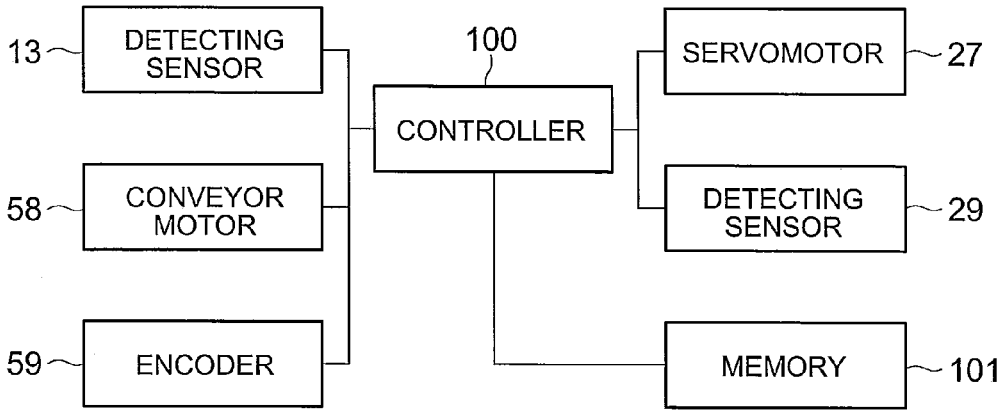
FIG. 8 is a block diagram showing a control system for synchronizing the take-out speed of the sheets at the conveyor portion of the sheet handling apparatus shown in FIG. 1 with the conveying speed of the sheets at the conveyor portion.

In order to satisfy this requirement, the inventors of the present application came up with the drive control of the take-out rotor 20 that is explained in the following. FIG. 8 is a block diagram showing a control system for synchronizing the take-out operation of the sheets P at the above-described take-out portion 1 and the conveying operation of the sheets P at the above-described conveyor portion 2. This control system includes the detecting sensors 13, the conveyor motor 58, the encoder 59, the servomotor 27, and the detecting sensor 29, which are respectively connected to the controller 100. Moreover, a memory 101 (storage portion) storing a target value of the conveying speed (target conveying speed) that is set in advanced is connected to the controller 100. It should be noted that a data table storing speed patterns of the take-out rotor 20 in accordance with lengths of the sheet P may be stored in the memory 101, as explained in the second embodiment.

Figure 9:
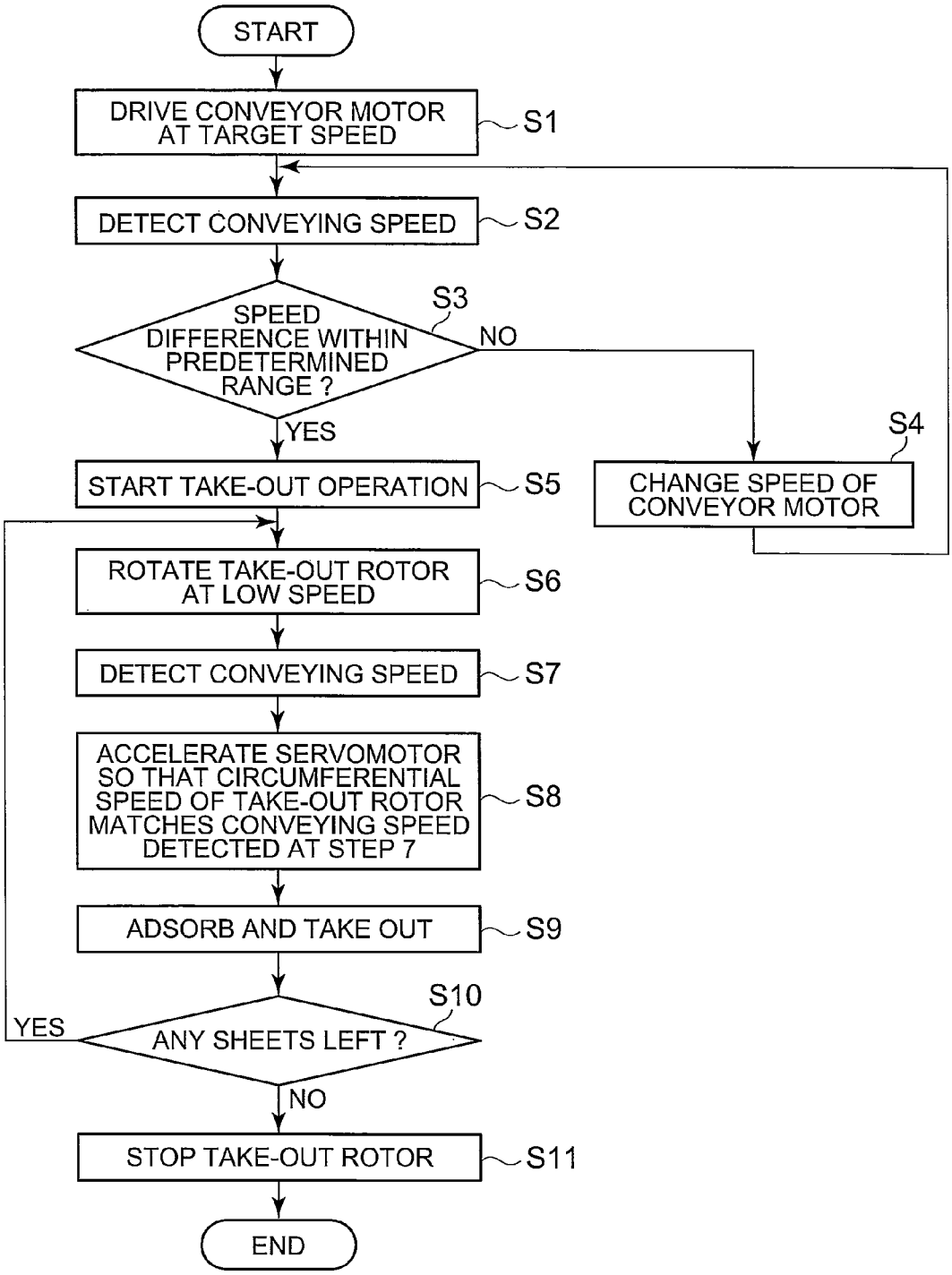
FIG. 9 is a flowchart illustrating the operation of the control system shown in FIG. 8.

FIG. 9 is a flowchart illustrating the control operation for synchronizing the take-out operation of the sheets P with the take-out rotor 20 with the conveying operation of the sheets P in the conveyor portion 2.

Before starting the take-out operation of the sheets P, the controller 100 first drives the conveyor motor 58 so as to adapt its speed to the target conveying speed read out from the memory 101, and causes the plurality of conveyor belts 50 to run at this target conveying speed (Step 1). Then, the controller 100 detects with the encoder 59 the running speed at which the conveyor belts 50 actually run, that is conveying speed of the sheets P (Step 2), and judges a speed difference between the detected actual conveying speed and the target conveying speed (Step 3).

If the result of this judgment in Step 3 is that the detected speed difference exceeds a pre-set speed difference range (Step 3: NO), then the controller 100 changes (adjusts) the rotation speed of the conveyor motor 58 so as to eliminate this speed difference (Step 4). For example, if the actual running speed of the conveyor belts 50 has become slower than the target speed, then the controller 100 adjusts the rotation speed of the conveyor motor 58 so that it becomes faster. Moreover, if the actual conveying speed has become faster than the target speed, then the controller 100 adjusts the rotation speed of the conveyor motor 58 so that it becomes slower.

Then, repeating the processing of Step 2 to Step 4, when the actual conveying speed approaches the target speed to within a constant speed difference range (Step 3: YES), then the controller 100 drives the servomotor 27 to rotate the take-out rotor 20, and begins the operation of taking out the sheet P (Step 5).

Figure 10:
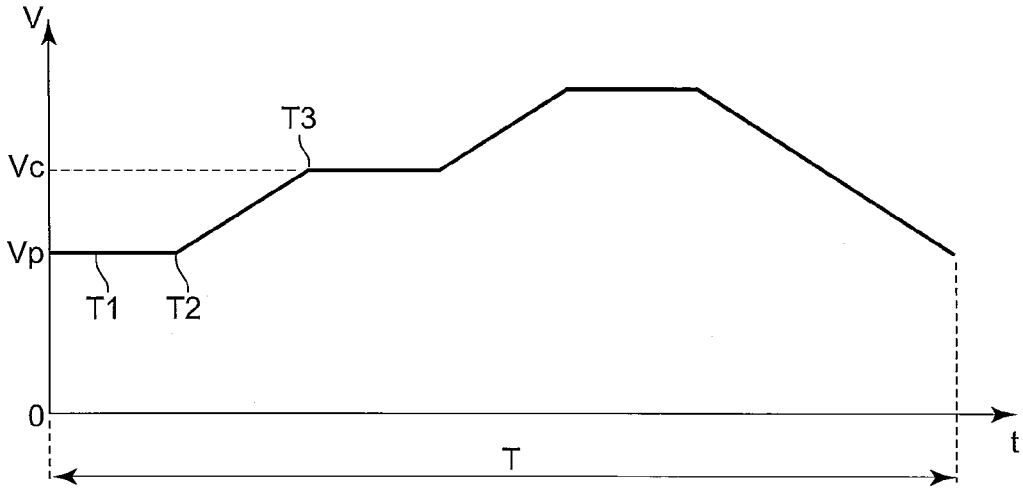
FIG. 10 is a graph showing a speed pattern of when the take-out rotor is rotated in accordance with the flowchart shown in FIG. 9.

At this time, the controller 100 changes the rotation speed of the take-out rotor 20 for example in accordance with the speed pattern shown in FIG. 10, and accelerates or decelerates the take-out rotor 20 each time a sheet P is taken out. The speed pattern of FIG. 10 shows an example of a speed change of the take-out rotor 20 when taking out one sheet P. As noted above, this speed pattern is prepared in advance as a data table in the memory 101.

It should be noted that also after beginning the take-out operation, the above-described processing of Step 2 to Step 4 may be carried out at a suitable timing, and the conveying speed of the sheets P at the conveyor portion 2 may be consistently controlled such that the predetermined target conveying speed is approached.

When the take-out operation is started in Step 5, first, at the timing at which the uppermost sheet P supplied to the take-out position is adsorbed to the take-out rotor 20 (T1 in FIG. 10), the controller 100 causes the take-out rotor 20 to rotate at a low speed Vp (<Vc) (Step 6). This rotation speed Vp is a speed that is sufficiently slower than the conveying speed at the conveyor portion 2 detected in Step 2. By causing the take-out rotor 20 to rotate at low speed in this manner and adsorbing the sheet P to its outer circumferential surface, it is possible to reliably adsorb the sheet P to the outer circumferential surface of the take-out rotor 20.

This adsorption timing is the timing at which the negative pressure generated at the outer circumferential surface of the take-out rotor 20 becomes maximal, and more specifically, it is the timing at which all adsorbing holes 21 of the take-out rotor 20 are in communication with the cutout portion 24*a* of the chamber 24 of the core member 22. It should be noted that this adsorption timing is judged by the controller 100 via the detecting sensor 29.

At this time, the controller 100 detects the momentary actual conveying speed of the conveyor portion 2, based on the output signal of the encoder 59 (Step 7). The servomotor 27 is accelerated so that the circumferential speed of the take-out rotor 20 becomes substantially the same speed as the conveying speed detected in Step 7 (Step 8), and the sheet P adsorbed to the take-out rotor 20 is taken out while being accelerated from the take-out position (Step 9).

That is to say, at the timing when the sheet P is adsorbed to the take-out rotor 20 and has started to move from the take-out position (T2 in FIG. 10), the controller 100 starts to accelerate the take-out rotor 20, and at the timing immediately prior to feeding the leading edge of the sheet P in take-out direction to the conveyor portion 2 (T3 in FIG. 10), the controller 100 matches the circumferential speed of the take-out rotor 20 to the actual conveying speed Vc detected in Step 7.

Thus, when the sheet P taken out with the take-out portion 1 is transferred to the conveyor portion 2, by matching the take-out speed with the conveying speed at this point in time, it can be prevented that there is a difference between the two speeds. Consequently, it is possible to transfer the sheet P smoothly from the take-out portion 1 to the conveyor portion 2. That is to say, it is thus possible to prevent such problems as buckling or ripping that occur due to the difference between the two speeds.

It should be noted that the conveying speed that is detected in Step 7 is the conveying speed of the conveyor portion 2 when the sheet P is taken out, so that it is the conveying speed of the immediately previously taken out sheet P. That is to say, in such cases as when the previously taken out sheet P is a relatively heavy postal item, it is conceivable that the running speed of the conveyor belts 50 is slowed down due to the load when conveying this heavy postal item. However, even in such cases, in the present embodiment, the actual conveying speed is detected when the sheet P is transferred from the take-out portion 1 to the conveyor portion 2, so that there is no difference between the two speeds.

After the take-out operation is started in Step 5, the controller 100 repeats the processing of the Steps 6 to 9 described above, until there are no more sheets P placed on the supply table 31 (Step 10: NO), and after all sheets P have been taken out, the take-out rotor 20 is stopped and the processing is finished (Step 11).

As described above, with the present embodiment, at the time when a sheet P is adsorbed to the take-out rotor 20, the take-out rotor 20 is rotated at a speed that is slower than the conveying speed of the sheets P at the conveyor portion 2, so that it possible to apply the negative pressure for a sufficient amount of time to the sheet P at the take-out position, and it is possible to adsorb the sheet P reliably to the outer circumferential surface of the take-out rotor 20.

Moreover, with the present embodiment, when the sheet P taken out with the take-out portion 1 is transferred to the conveyor portion 2, the rotation speed of the take-out rotor 20 is controlled such that the actual conveying speed of the conveyor portion 2 matches the take-out speed of the sheet P. For this reason, independently of whether the operation of the handling apparatus 200 is just being started or whether it is already operating, and independently of environmental changes or load changes, it is possible to consistently take out the sheets P in predetermined intervals onto the conveying path. Thus, the sheets P can be conveyed at a predetermined conveying speed, pitch interval and timing, it becomes possible to precisely carry out the processing of the sheets P at the sorting portion 3, the inspection portion 4 and the sheet stacker 6, and the operation of the handling apparatus 200 can be stabilized.

Furthermore, with the present embodiment, due to the processing explained for Steps 2 to 4 in FIG. 9, a control is possible to ensure that the conveying speed of the sheets P at the conveyor portion 2 always approaches the target conveying speed. That is to say, even if the physical values of the conveyor belts 50 change due to the usage environment and the usage time of the handling apparatus 200, the rotation speed of the conveyor motor 58 is adjusted to this change, and the conveying speed of the conveyor belts 50 are controlled to the target conveying speed.

Figure 11:
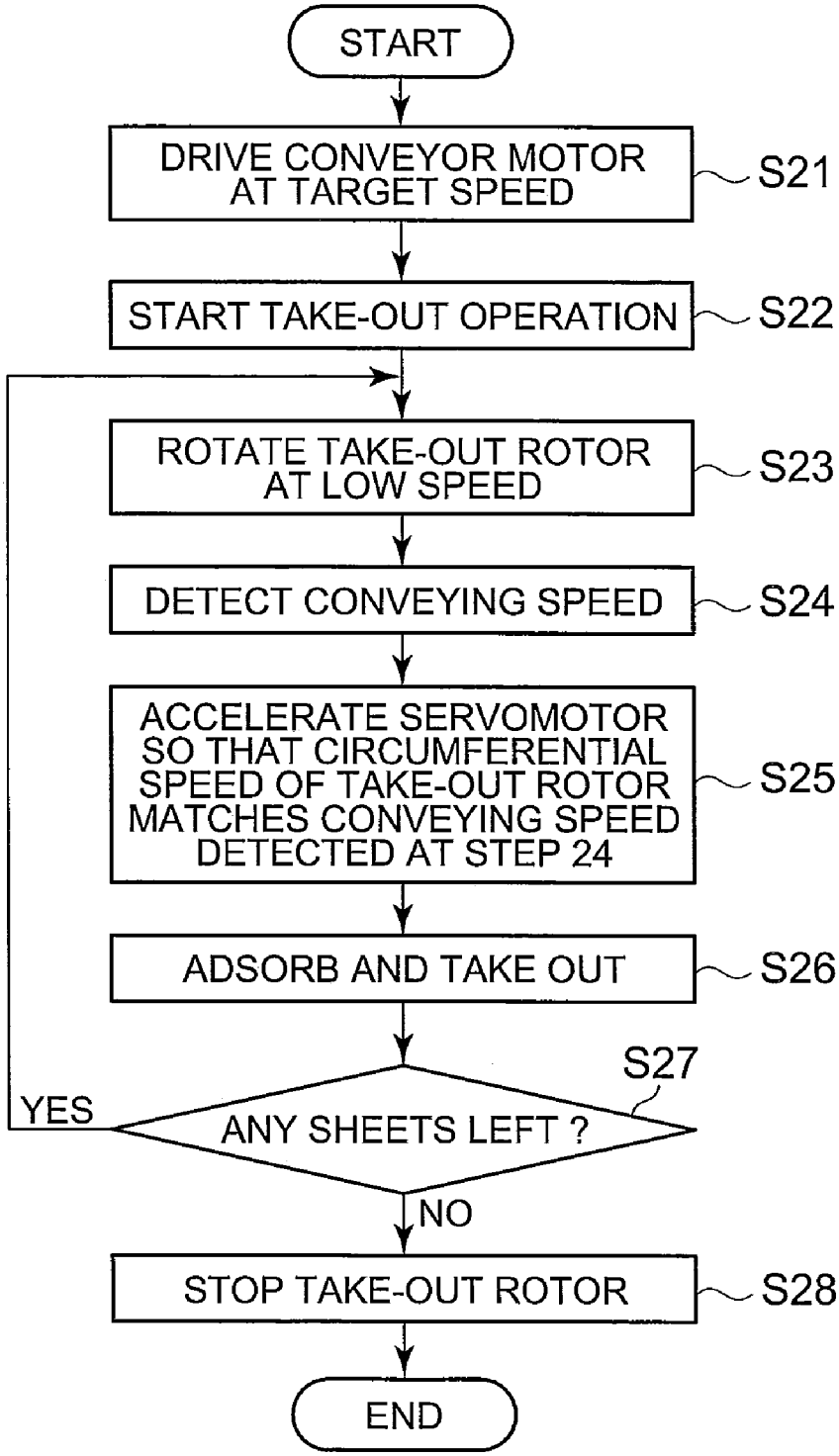
FIG. 11 is a modification example of the flowchart shown in FIG. 9.

It should be noted that the above-described embodiment has been explained for the case that it includes the processing of Steps 2 to 4 in FIG. 9, but there is no limitation to this, and the processing of Steps 2 to 4 is not necessarily required. In other words, if the change of speed that occurs over time in the above-described conveyor portion 2 stays within a tolerance range, then it is also possible to omit these steps, as shown in FIG. 11.

That is to say, in this case, after the conveyor motor 58 has been driven to the target conveying speed (Step 21), the controller 100 drives and controls the take-out portion 1 and the operation of taking out the sheet P is started (Step 22).

Then, at the timing when the sheet P is being adsorbed, the controller 100 rotates the take-out rotor 20 at low speed (Step 23), and the conveying speed of the conveyor portion 2 at this time is detected (Step 24), as described above. The servomotor 27 is accelerated such that the circumferential speed of the take-out rotor 20 becomes substantially the same speed as the conveying speed detected in Step 24 (Step 25), and the sheet P adsorbed to the take-out rotor 20 is taken out from the take-out position (Step 26).

Until there are no more sheets P left to be taken out (Step 27: NO), the controller 100 repeats this processing of the steps 23 to 26, and stops the take-out rotor 20 (Step 28).

By omitting several processing steps as in FIG. 11, a more economical system can be provided. In this case, even if the conveying speed of the conveyor portion 2 deviates from the target conveying speed over time, the take-out speed is controlled so as to be adapted to this deviating conveying speed, but when the sheet P of the take-out position is adsorbed to the take-out rotor 20, the rotation speed of the rotor is sufficiently slowed down, so that the there is no risk of take-out problems.

The following is an explanation of a second embodiment, with reference to FIGS. 12 to 16. The sheet handling apparatus of this embodiment has substantially the same structure as the above-described sheet handling apparatus 200 of the first embodiment. Thus, the same numerals are given to structural elements having the same function as in the above-described first embodiment, and a detailed explanation of their configuration has been omitted. That is to say, the following explanations relate primarily to the difference in the method for taking out sheets P.

By slowing down the circumferential speed of the take-out rotor 20 below the conveying speed of the conveyor portion at a timing when the plurality of adsorbing holes 21 of the take-out rotor 20 oppose the sheet P at the take-out position (that is, at the timing when the sheet P at the take-out position is being adsorbed), as in the above-described first embodiment, it is possible to favorably adsorb the sheet P to the outer circumferential surface of the take-out rotor 20, but on the other hand, the time for rotating the take-out rotor 20 once for the sheet P to be taken out next (that is to say, the time until the plurality of adsorbing holes 21 again oppose the take-out position) is increased in correspondence with the slowing down of the circumferential speed of the take-out rotor 20.

That is to say, compared to the conventional case in which the take-out rotor 20 is rotated at a constant circumferential speed without being accelerated or decelerated at the same speed as the conveying speed of the sheets P in the conveyor portion 2 (see FIG. 14), the time interval over which the plurality of adsorbing holes 21 pass through the take-out position (that is, the time it takes the take-out rotor 20 to complete one rotation) becomes long, the take-out pitch of the sheets P becomes long, and the processing capability of the apparatus may be lower than conventionally.

Therefore, in order to let the plurality of adsorbing holes 21 face the take-out position again fast, it is conceivable to reduce the diameter (that is, the outer circumferential length) of the take-out rotor 20, but by employing this approach, also the radius of curvature of the take-out rotor 20 becomes small, and it becomes more difficult to adsorb the sheets to the outer circumferential surface of the take-out rotor 20.

Also, to change the diameter of the take-out rotor 20 as explained above, it is necessary to considerably change the configuration of the take-out portion 1 and it is not possible to use conventional take-out rotors 20 in unaltered form. That is to say, ideally, it is desirable that the rotation speed of the take-out rotor 20 can be sufficiently reduced when the plurality of adsorbing holes 21 pass the take-out position, a conventional take-out rotor can be used in unaltered form, and the sheet P can be taken out at the same pitch as with a conventional take-out rotor.

Therefore, in the present embodiment, after the sheet P taken out with the take-out portion 1 has been transferred to the conveyor portion 2, the rotation speed of the take-out rotor 20 is temporarily increased in order to compensate for the amount that the circumferential speed of the take-out rotor 20 has been decelerated during the adsorbing of the sheet P, and the take-out pitch of the sheet P is adjusted to the desired value. In the following, the operation for taking out a sheet P in accordance with the present embodiment is explained with reference to the flowchart shown in FIG. 12.

Prior to the sheet take-out operation, the controller 100 of the handling apparatus 200 first draws a vacuum into the chamber 24 by operating the vacuum pump 23. Then, the controller 100 rotates the take-out rotor 20 by driving the servomotor 27, and starts the operation of taking out the sheets P (Step 1).

Figure 13:
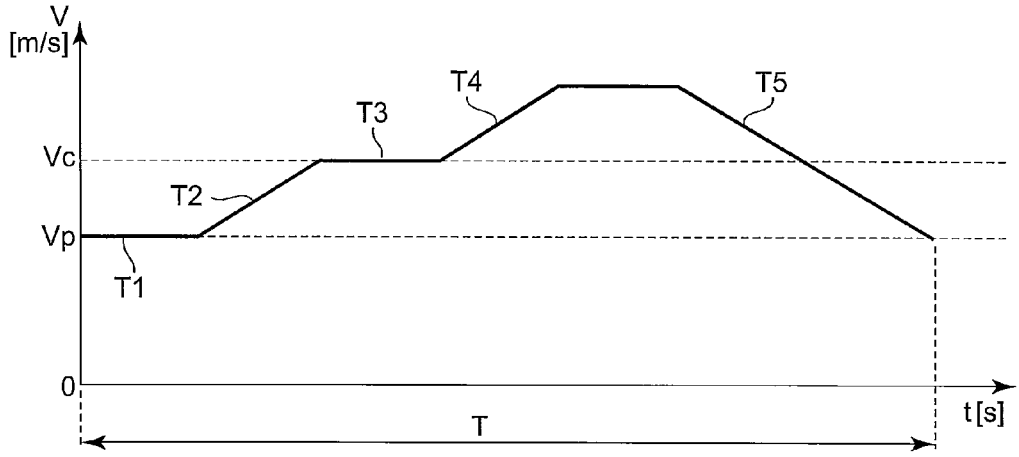
FIG. 13 is a graph showing an example of a speed pattern of the take-out rotor whose operation is controlled in accordance with the flowchart shown in FIG. 12.
Figure 14:
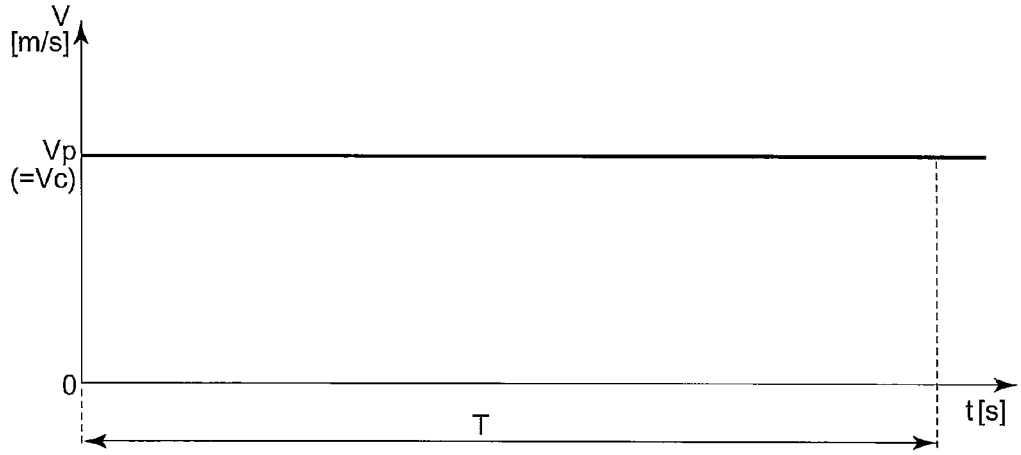
FIG. 14 is a graph showing a conventional speed pattern in which the rotation speed of the take-out rotor is constant.

At this time, the controller 100 changes the rotation speed of the take-out rotor 20 in accordance with the speed pattern shown in FIG. 13, for example. That is to say, the controller 100 rotates the take-out rotor 20 once every time a sheet P is taken out, while accelerating and decelerating the take-out rotor 20 in accordance with the speed pattern in FIG. 13. The speed pattern in FIG. 13 is an example of a speed change for one rotation of the take-out rotor 20, when one sheet P is taken out. This speed pattern is prepared in advance in accordance with the length of the sheet P in take-out direction, and stored in a data table of the memory 101.

When the take-out operation is started in Step 1, first, at the timing at which the uppermost sheet P supplied to the take-out position is adsorbed to the take-out rotor 20 (that is, the timing when the plurality of adsorbing holes 21 pass the take-out position) (T1 in FIG. 13), the controller 100 causes the take-out rotor 20 to rotate at a low speed Vp (<Vc) (Step 2). The rotation speed Vp of the take-out rotor at this time is a speed that is slower than the conveying speed at the conveyor portion 2. By driving the take-out rotor 20 at low speed in this manner and adsorbing the sheet P to its outer circumferential surface, it is possible to let the sheet P reliably adsorb to the take-out rotor 20, and to reliably take out the sheet P at the take-out position (Step 3).

Then, after the sheet P has been adsorbed to the take-out rotor 20 and has been taken out from the take-out position in Step 3, the controller 100 accelerates the servomotor 27 such that the speed Vp of the take-out rotor 20 becomes substantially the same speed as the conveying speed Vc of the conveyor portion 2 (Vp=Vc) (Step 4, T2 in FIG. 13), and the sheet P adsorbed to the take-out rotor 20 is transferred to the conveyor belts of the conveyor portion 2 (Step 5, T3 in FIG. 13).

That is to say, the controller 100 begins to accelerate the take-out rotor 20 at the timing when the sheet P is adsorbed to the take-out rotor 20 and begins to move from the take-out position, and at the timing immediately prior to when the front end of the sheet P in take-out direction is fed to the conveyor belts of the conveyor portion 2, the circumferential speed Vp of the take-out rotor 20 substantially matches the conveying speed Vc.

Thus, when the sheet P taken out with the take-out portion 1 is transferred to the conveyor portion 2, by synchronizing the speed of the take-out rotor 20 with the conveying speed, it can be prevented that there is a difference between the two speeds, and the sheet P can be transferred smoothly from the take-out portion 1 to the conveyor portion 2. Thus, it is possible to prevent such problems as buckling or ripping that may occur due to the speed difference when transferring the sheet P.

After the sheet P is transferred to the conveyor portion 2 in Step 5, when the plurality of adsorbing holes 21 of the take-out rotor 20 pass the cutout portion 24*a* of the chamber 24, the negative pressure that was generated at the outer circumferential surface of the take-out rotor 20 is removed. Thus, the adsorbing force of the take-out rotor 20 with respect to the sheet P is removed, and the sheet P is thereafter sandwiched by the conveyor belts 50 of the conveyor portion 2 and conveyed to the following processing portions (Step 6).

After this, at the timing when the negative pressure at the outer circumferential surface of the take-out rotor 20 is removed (that is, at the timing at which the adsorbing force of the take-out rotor 20 with respect to the sheet P is removed), the controller 100 starts the acceleration of the take-out rotor 20. That is to say, at this timing, the controller 100 accelerates the take-out rotor 20 such that the circumferential speed Vp (>Vc) of the take-out rotor 20 becomes larger than the conveying speed Vc (Step 7, T4 in FIG. 13).

Then, after a predetermined time has passed after the acceleration in Step 7, the controller 100 starts to decelerate the take-out rotor 20, and decelerates the circumferential speed of the take-out rotor 20 to a speed that is slower than the conveying speed (Step 8, T5 in FIG. 13). At this time, the controller 100 decelerates the take-out rotor 20 to the speed of Step 2, so that the sheet P that is taken out next can be favorably adsorbed to the outer circumferential surface of the take-out rotor 20.

When the operation up to Step 8 is finished, the controller 100 detects the adsorbing position of the take-out rotor 20 (that is, the position of the plurality of adsorbing holes 21) with the detecting sensor 29, and based on the detection result, adjusts the take-out timing of the next sheet P (Step 9). That is to say, at this time, the controller 100 corrects the speed pattern of the take-out rotor 20 such that the plurality of adsorbing holes 21 of the take-out rotor 20 are opposed to the take-out position at constant time intervals (T). Thus, for example even if there is slip between the sheet P and the take-out rotor 20, it is possible to maintain the take-out pitch of the sheets P substantially constant.

After the take-out operation has started in Step 1, the controller 100 repeats the processing of the above-described Steps 2 to 9 until there are no sheets P left on the supply table 31 (Step 10: NO), and after all sheets P have been taken out, it stops the take-out rotor 20 and finishes the processing (Step 11).

Thus, also in this embodiment, the same effect can be achieved as with the above-described first embodiment. That is to say, with the present embodiment, since, when the sheets P are adsorbed to the take-out rotor 20, the take-out rotor 20 is driven at a speed that is slower than the conveying speed of the sheets P at the conveyor portion 2, the negative pressure can act for a sufficiently long time on the sheet P at the take-out position and the sheet P can be adsorbed reliably to the take-out rotor 20.

Moreover, with the present embodiment, when the sheet P that has been taken out by the take-out portion 1 is transferred to the conveyor portion 2, the rotation of the take-out rotor 20 is controlled such that the conveying speed matches the take-out speed. Thus, it is possible to prevent such problems as buckling or ripping that are caused by a speed difference at the time of the transfer of the sheet P.

Furthermore, with the present embodiment, in a region in which no adsorbing force of the take-out rotor 20 acts on the sheet P, the circumferential speed of the take-out rotor 20 is temporarily accelerated to a speed that is faster than the conveying speed. Thus, after making the rotating speed of the take-out rotor 20 at the time of adsorption of the sheet P sufficiently slower than the conveying speed, it is possible to take out a plurality of sheets P onto the conveying path at the same take-out pitch as if, as conventionally, the take-out rotor is rotated at the same constant speed as the conveying speed.

That is to say, with the present embodiment, a take-out rotor 20 with the same structure as a conventional one can be used, the take-out rotor 20 can be rotated at a circumferential speed that is slower than the conveying speed to adsorb and take out the sheet P at the take-out position, and a plurality of sheets P can be taken out at the same take-out pitch as in the case that the take-out rotor 20 is rotated at the same circumferential speed as the conveying speed. In other words, by using the take-out method of the present embodiment, it is possible to convey the sheets P at the desired conveying speed, pitch distance and timing, it becomes possible to precisely process the sheets P with the sorting portion 3, the inspection portion 4 and the sheet stacker 6, and the operation of the handling apparatus 200 can be stabilized.

Figure 15:
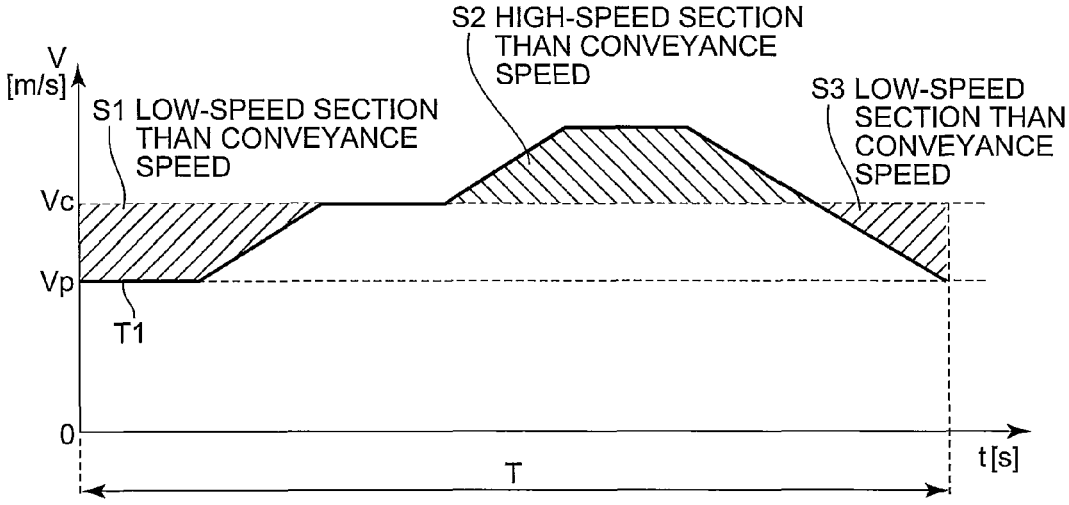
FIG. 15 is a graph to illustrate the speed pattern shown in FIG. 13 in more detail.

Referring to FIG. 15, the speed pattern of the above-described second embodiment is examined from a different angle. The speed pattern of the second embodiment has the feature that a temporal loss due to slowing down the circumferential speed of the take-out rotor 20 to below the conveying speed when the sheet P of the take-out position is adsorbed to the outer circumferential surface of the take-out rotor 20 is compensated by temporarily accelerating the take-out rotor 20 to a speed that is faster than the conveying speed, after the sheet P has been transferred to the conveyor portion 2.

Simply speaking, the speed pattern of the take-out rotor 20 may be set in such a manner that the moving distance of the outer circumferential surface of the take-out rotor 20 obtained by integrating the circumferential speed during one rotation of the take-out rotor 20 over the time T for one rotation becomes the same as the moving distance of the outer circumferential surface when the take-out rotor 20 is rotated for the time T at a circumferential speed Vc that is the same as the conveying speed.

That is to say, explaining this with reference to FIG. 15, the speed pattern of the take-out rotor 20 may be set such that S1, S2 and S3 satisfy the following equation, where S1 is the area of the hatched region in FIG. 15 indicating that the take-out rotor 20 is rotated at a circumferential speed that is slower than the conveying speed Vc during adsorption of the sheet P, S2 is the area of the hatched region in FIG. 15 indicating that the take-out rotor 20 is rotated at a circumferential speed that is faster than the conveying speed Vc after the sheet P has been transferred to the conveyor portion 2, and S3 is the area of the hatched region in FIG. 15 indicating a circumferential speed of the take-out rotor 20 that is slower than the conveying speed Vc when the circumferential speed has been decelerated in order to take out the next sheet P.

$$S1+S3=S2 \quad \text{(Equation 1)}$$

In other words, the speed pattern of the second embodiment is not limited to the pattern shown as an example in FIG. 15, and it may also be any speed pattern where the circumferential speed of the take-out rotor 20 is controlled in such a manner that the above equation is satisfied. Putting this in yet different words, the speed pattern may be set such that the plurality of adsorbing holes 21 pass the take-out position in constant time intervals.

Figure 17:
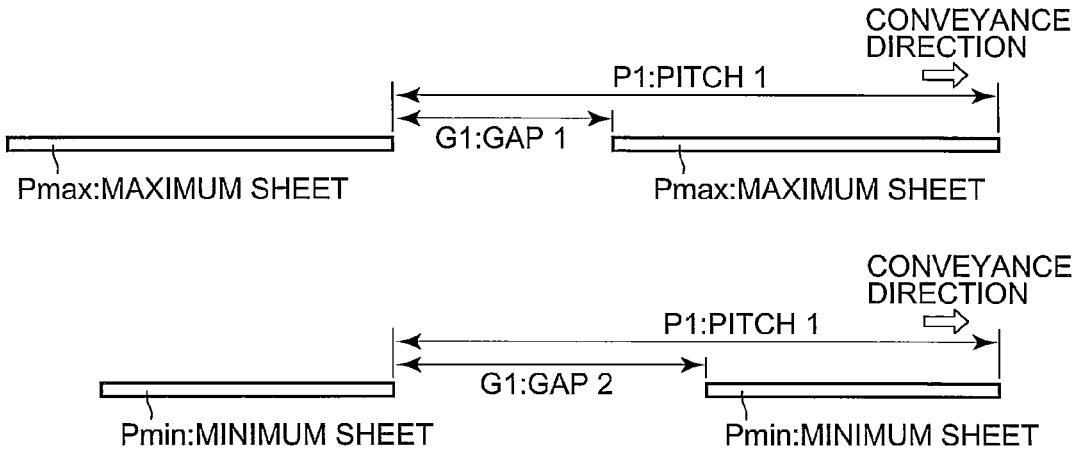
FIG. 17 is a diagram illustrating how a sheet is taken out so that the conveying pitch becomes constant.

Now, if a plurality of sheets P are taken out consecutively onto the conveying path by controlling the take-out portion 1 with the methods of the above-described embodiments, then the sheets P are transferred to the conveyor portion 2 at a constant timing, and the plurality of sheets P are conveyed at constant pitch by the conveyor portion 2. Therefore, if the length of the sheets P in the conveying direction is sometimes shorter and sometimes longer, and the sheets P are taken out by rotating the take-out rotor 20 with the same speed pattern, then the conveying gaps between the sheets P will differ (see FIG. 17).

Figure 18:
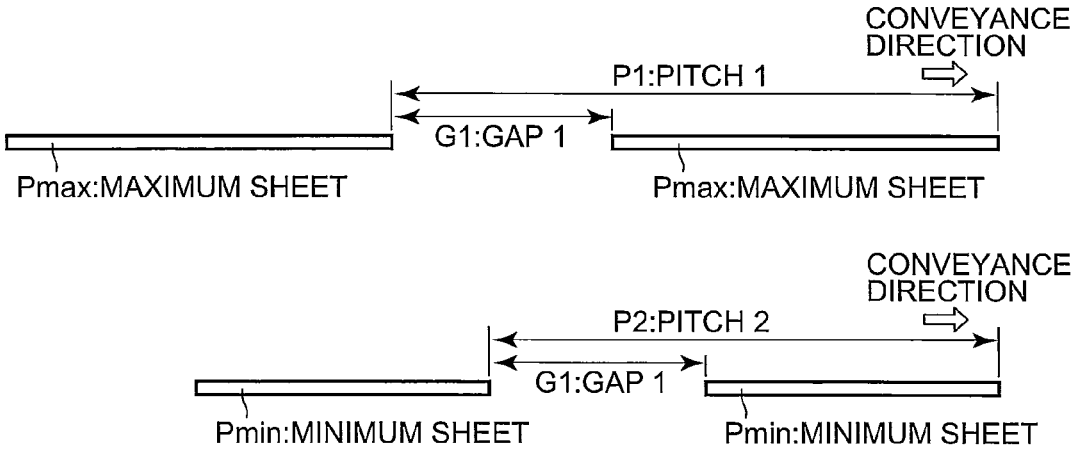
FIG. 18 is a diagram illustrating how a sheet is taken out so that the gap between sheets becomes constant.

For example, if sheets P whose length in conveying direction is short are consecutively taken out by rotating the take-out rotor 20 with the same speed pattern, then the conveying gaps between the sheets P become longer than necessary. That is to say, when the gaps between the sheets P become wider than conveying gaps that are suitable for efficiently processing the sheets P, then the processing efficiency of the sheets P drops. In this case, the processing efficiency of the sheets P is lowered proportionally to the amount that the conveying gaps are widened and the processing capability of the handling apparatus 200 is lowered. Thus, in this case, it is desirable to change the speed pattern of the take-out rotor 20 such that the conveying gaps become small and approach the suitable conveying gaps, increasing the processing efficiency (see FIG. 18).

Figure 19:
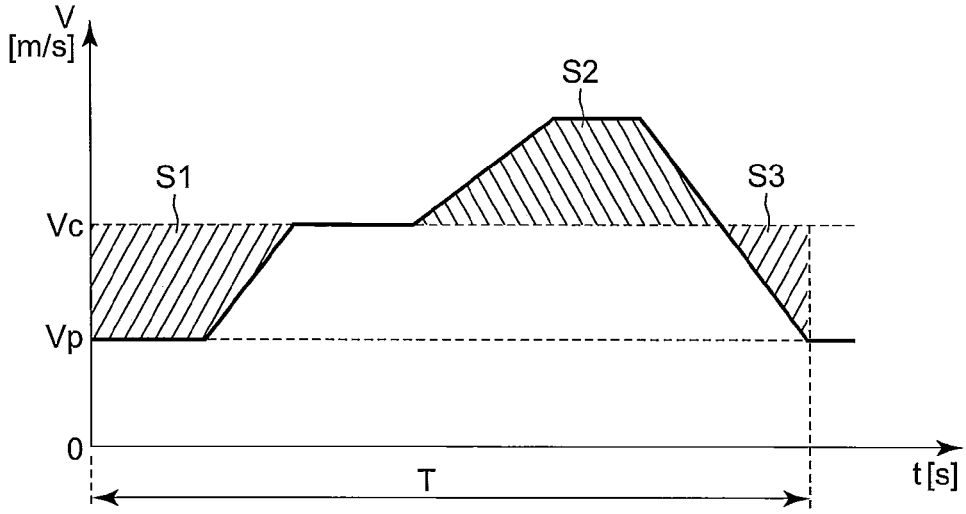
FIG. 19 is a graph showing the speed pattern when taking out the sheets such that the conveying pitch becomes constant.
Figure 20:
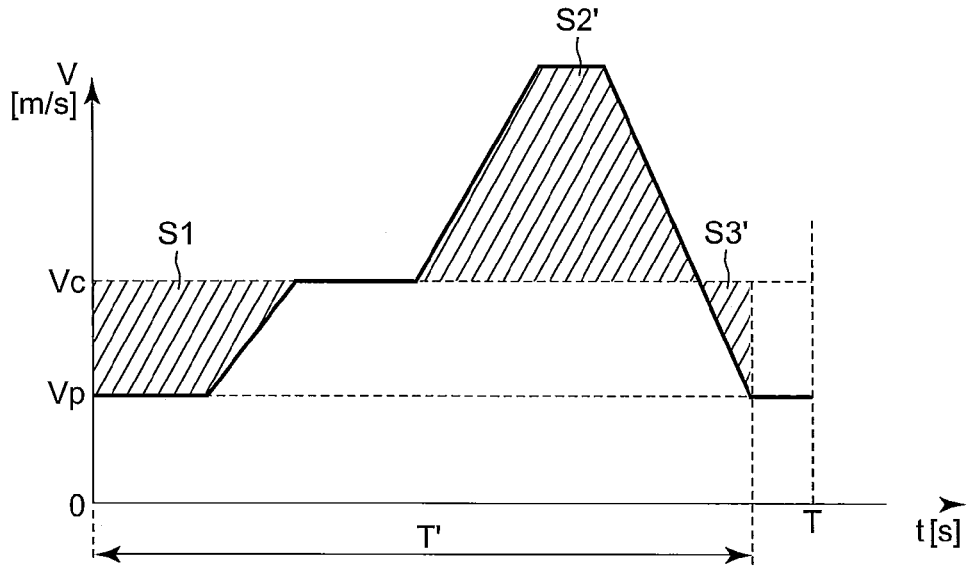
FIG. 20 is a graph showing the speed pattern when taking out the sheets such that the gap between the sheets becomes shorter.

If the conveying gaps become short, the pitch time T' in FIG. 20 should be made smaller than the pitch time T in FIG. 19. Furthermore, the speed pattern should be set such that the moving distance of the adsorbing holes in the outer circumferential surface becomes the same as when the take-out rotor 20 is rotated for the time T at the same circumferential speed Vc as the conveying speed. More specifically, considering the difference (T−T') between the time T' and the time T, the speed pattern is changed such that the following relation is maintained:

$$S1+S3'+(T-T')\times Vc=S2' \quad \text{(Equation 2)}$$

Figure 21:
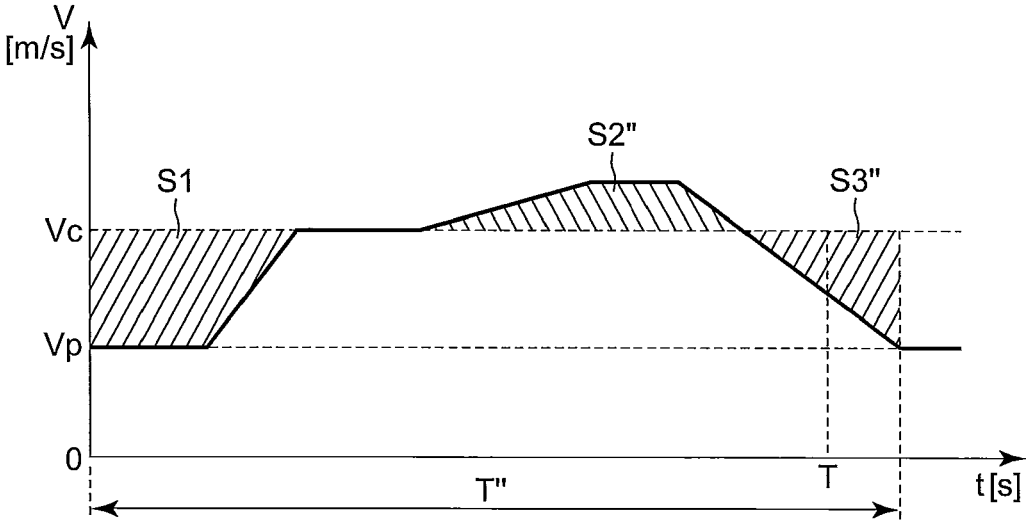
FIG. 21 is a graph showing the speed pattern when taking out the sheets such that the gap between the sheets becomes longer.

The third term on the left corresponds to the shortening of the pitch time, and due to it, the area of the acceleration section S2' becomes larger. In other words, by accelerating more in S2', the pitch time becomes T' (<T). If the conveying gap becomes larger (FIG. 21), then the foregoing idea can be similarly applied and the speed pattern can be changed such that such that the following relation is maintained:

$$S1+S3''=S2''+(T''-T)\times Vc \quad \text{(Equation 3)}$$

The second term on the right corresponds to the increase of the pitch time, and due to it, the area of the acceleration section S2" becomes smaller. In other words, by accelerating not so much in S2", the pitch time becomes T" (>T).

More specifically, speed patterns at which the plurality of sheets P can be taken out with a constant gap and a suitable gap between the sheets P can be maintained are calculated in advance in accordance with lengths of the sheets P in conveying direction, and speed patterns corresponding to these lengths are stored in the data table of the memory 101. Then, when a sheet P is taken out, the controller 100 detects the length, in the conveying direction, of the sheet P taken out onto the conveying path, reads the speed pattern suitable for this length from the data table of the memory 101, and controls the servomotor 27 of the take-out portion 1 in accordance with the read out speed pattern.

Thus, with the above-described embodiments, a sheet handling apparatus and a sheet handling method can be provided, with which stacked sheets can be taken out one by one by reliably adsorbing them to the take-out rotor, the sheets that have been taken out can be reliably transferred to the conveyor portion, and the sheets can be conveyed consistently at relatively high speed with the conveyor portion.

While certain embodiments have been described, those embodiments have been presented by way of example only, and are not intended to limit the scope of the inventions. Indeed, the novel methods and apparatuses described herein may be embodied in a variety of other forms; furthermore, various omissions, substitutions and changes in the form of the methods and apparatuses described herein may be made without departing from the spirit of the inventions. The accompanying claims and their equivalents are intended to cover such forms or modifications as would fall within the scope and spirit of the inventions.

For example, in the above-described embodiments, the take-out rotor 20 and the servomotor 27 are connected by a coupling 26, but it is also possible to employ a driving transmission mechanism using a different mechanism, such as a timing belt and a timing pulley. Furthermore, instead of the detecting sensor 29, it is also possible to use an encoder that is integrated into the servomotor 27. In particular, detecting the positions of the plurality of adsorbing holes 21 of the take-out rotor 20 with an encoder, as in the second embodiment, can increase the detection precision and is therefore advantageous.

Figure 12:
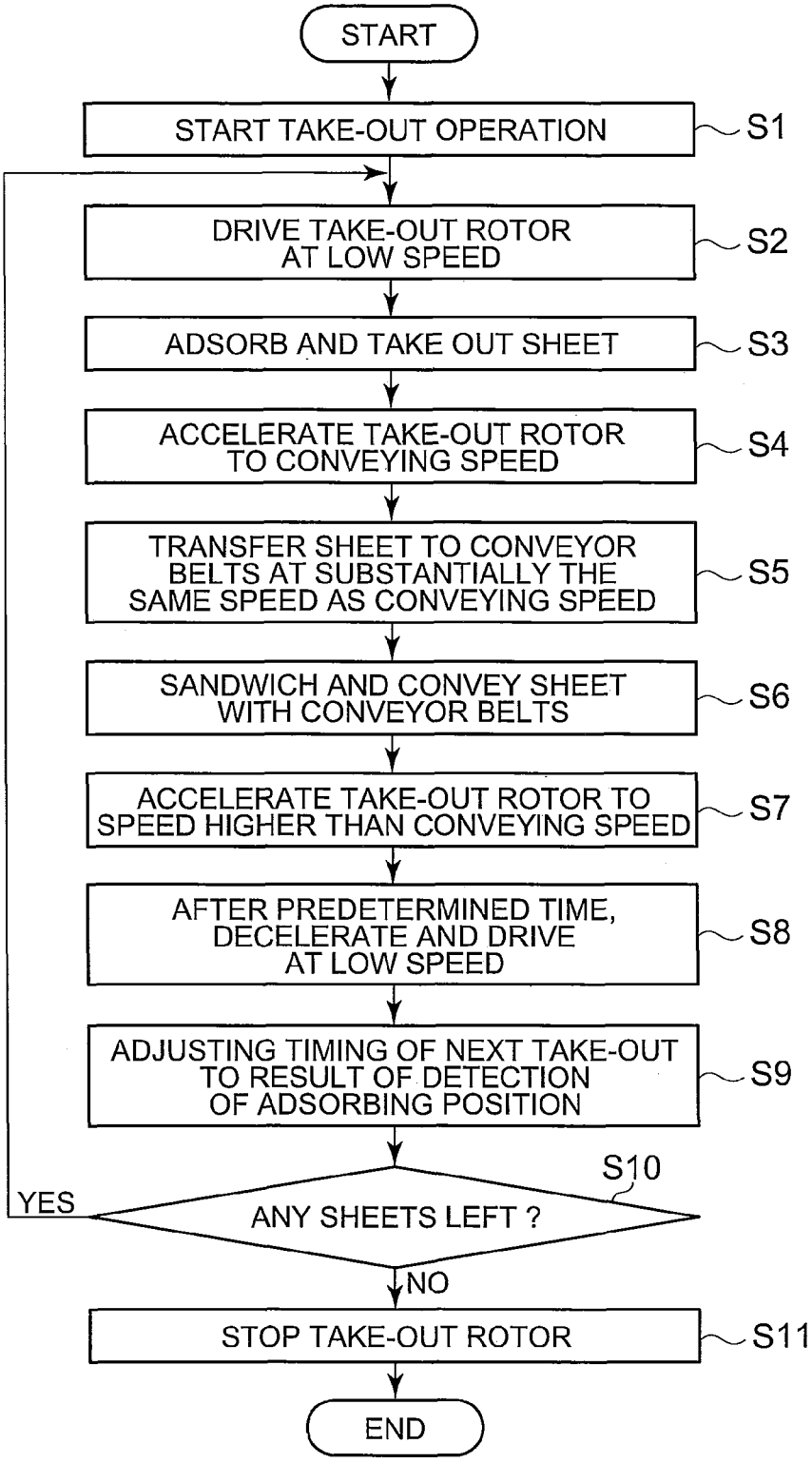
FIG. 12 is a flowchart to illustrate the sheet take-out operation in accordance with the second embodiment.
Figure 16:
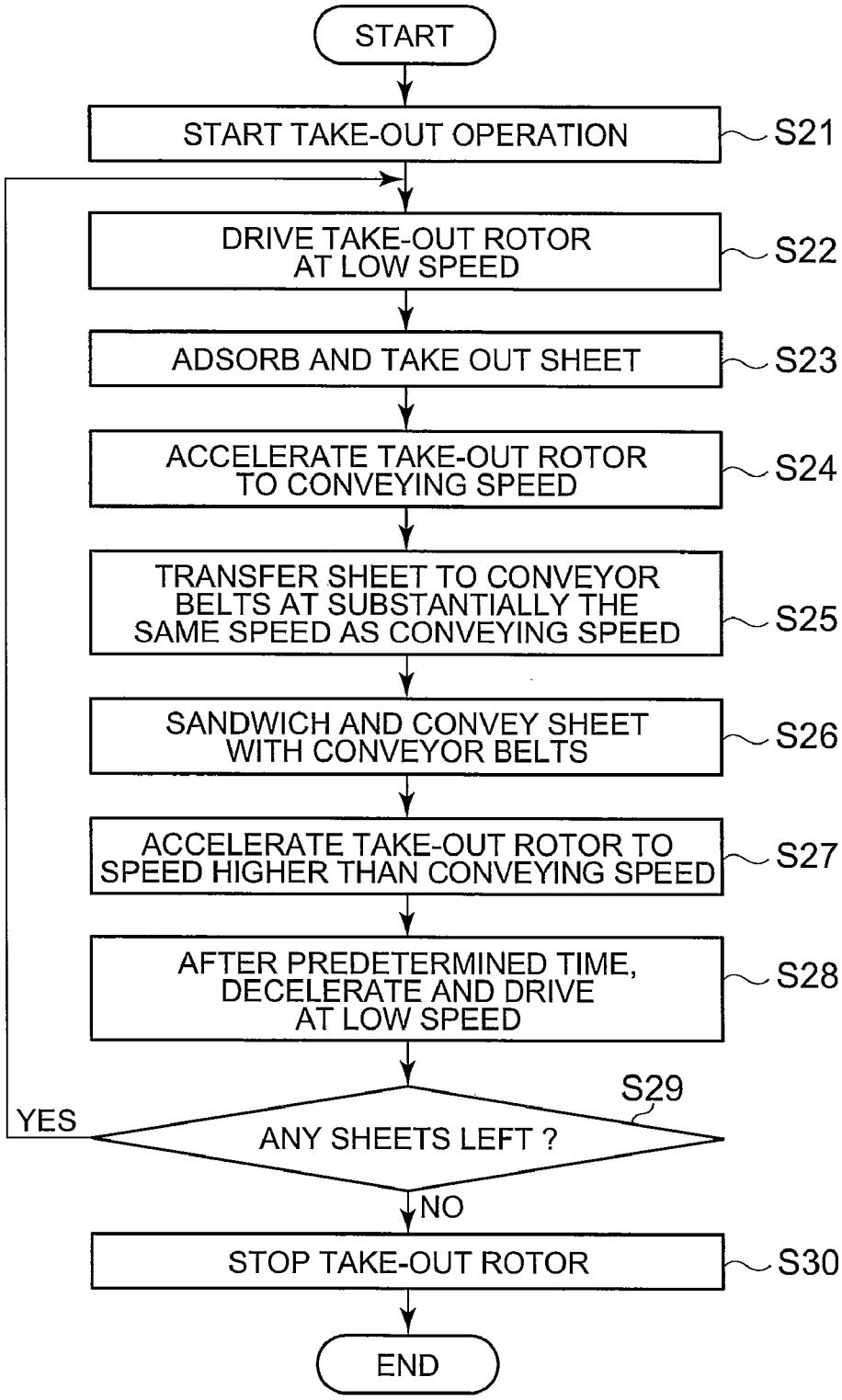
FIG. 16 is a modification example of the flowchart shown in FIG. 12.

Furthermore, the above second embodiment has been described for the case including Step 9 in FIG. 12, but there is no limitation to this, and the processing of Step 9 (adjusting the timing in accordance with the detection sensor) is not necessarily required. That is to say, if there is a certain tolerance for variations in the take-out pitch interval of the sheets P in the above-described take-out portion 1, then it is also possible to omit this step, as shown in FIG. 16.

In this manner, a more economical system can be provided by omitting a process step. For example, if processing speed and precision of the pitch interval are not required (for example in low-speed machines or medium-speed machines), then it is also possible to eliminate the adjustment processing with Step 9 in FIG. 12. In this case, there is no adjustment processing with the detection sensor 29, but it is possible to make the speed of the take-out rotor sufficiently slow when adsorbing the sheet P at the take-out position to the take-out rotor 20, so that there is no risk of take-out problems or worsening of the take-out pitch intervals.

While certain embodiments have been described, those embodiments have been presented by way of example only, and are not intended to limit the scope of the inventions. Indeed, the novel methods and apparatuses described herein may be embodied in a variety of other forms; furthermore, various omissions, substitutions and changes in the form of the methods and apparatuses described herein may be made without departing from the spirit of the inventions. The accompanying claims and their equivalents are intended to cover such forms or modifications as would fall within the scope and spirit of the inventions.

What is claimed is:

1. A sheet handling apparatus, comprising:

a take-out member to take out a sheet from a take-out position by rotating in a state in which a negative pressure is applied to the sheet at the take-out position and the sheet is adsorbed to the take-out member;

a conveyor portion to receive and convey the sheet taken out from the take-out position by the take-out member; and a control portion to control the take-out member such that, when the sheet at the take-out position is being adsorbed to the take-out member, the take-out member is rotated at a circumferential speed that is slower than a conveying speed of the sheet at the conveyor portion, and when the sheet adsorbed to the take-out member is being transferred to the conveyor portion, the take-out member is rotated at a circumferential speed that is the same as a conveying speed of the conveyor portion at that time.

2. The apparatus according to claim 1, further comprising:

a detecting portion to detect a conveying speed of the sheet with the conveyor portion, wherein the control portion controls the take-out member such that the take-out member rotates at a speed that is adapted to the conveying speed detected by the detecting portion.

3. The apparatus according to claim 2, wherein the conveyor portion includes a pair of conveyor belts running in a conveying direction while sandwiching the sheet taken out from the take-out position, a pulley around which the pair of conveyor belts is wrapped, and a conveyor motor to rotate this pulley, wherein the detecting portion includes an encoder to detect the conveying speed by detecting a rotation speed of the pulley.

4. The apparatus according to claim 3, further comprising:

a storage portion to store a target conveying speed of the conveyor portion, wherein the control portion controls the conveyor motor such that the conveying speed detected by the detecting portion approaches the target conveying speed stored in the storage portion.

5. The apparatus according to claim 2, wherein the detecting portion includes a plurality of sensors arranged at positions that are spaced apart by a predetermined distance along the conveying direction of the sheet in the conveyor portion, and the conveying speed of the sheet is calculated from a time it takes the sheet to pass the distance between the sensors.

6. The apparatus according to claim 1, wherein the control portion further controls the take-out member such that the take-out member rotates at a circumferential speed that is faster than the conveying speed of the conveyor portion, after the sheet has been transferred to the conveyor portion.

7. The apparatus according to claim 6, wherein the control portion, after rotating the take-out member at the faster circumferential speed, further controls the take-out member such that the take-out member is decelerated to the slower circumferential speed, in order to take out the next sheet.

8. The apparatus according to claim 7, further comprising:

a storage portion to store a speed pattern of the take-out member, wherein the control portion controls the take-out member such that the take-out member rotates in accordance with the speed pattern stored in the storage portion.

9. The apparatus according to claim 7, further comprising:

a detecting portion to detect an adsorption timing at which the take-out member adsorbs the sheet at the take-out position, wherein the control portion controls the take-out member such that a circumferential speed of the take-out member is corrected based on a detection result of the detecting portion, after the sheet has been transferred to the conveyor portion until the next sheet is adsorbed, such that the next sheet is adsorbed at a predetermined adsorption timing.

10. The apparatus according to claim 7, wherein the control portion controls the circumferential speed of the take-out member such that an interval between adsorption timings at which the take-out member adsorbs the sheet at the take-out position becomes a predetermined time interval.

11. The apparatus according to claim 7, wherein the control portion controls the circumferential speed of the take-out member such that a conveying pitch of the sheets in the conveyor portion becomes constant.

12. The apparatus according to claim 7, wherein a moving distance of an adsorbing surface of the take-out member after the sheet at the take-out position has been adsorbed to the adsorbing of the next sheet is the same as a conveying pitch of the sheets in the conveyor portion.

13. A sheet handling method, comprising:

taking out a sheet from a take-out position by adsorbing the sheet to a take-out member by applying a negative pressure to the sheet at the take-out position, and rotating the take-out member; and receiving and conveying the sheet taken out from the take-out position with a conveyor portion, wherein, in the take-out step, when the sheet at the take-out position is being adsorbed to the take-out member, the take-out member is rotated at a circumferential speed that is slower than a conveying speed of the sheet in the conveyor step, and when the sheet adsorbed to the take-out member is being transferred to the conveyor portion, the take-out member is rotated at a circumferential speed that is the same as a conveying speed in the conveying step at that time.

14. The method of claim 13, further comprising:

detecting the conveying speed of the sheet conveyed in the conveying step, wherein, in the take-out step, a rotation speed of the take-out member is controlled such that the rotation speed is adapted to the conveying speed detected in the detecting step.

15. The method of claim 13, further comprising:

rotating the take-out member at a circumferential speed that is faster than the conveying speed in the conveying step, after the sheet has been transferred to the conveyor portion.

16. The method of claim 15, further comprising:

decelerating the take-out member to the slower circumferential speed, in order to take out the next sheet, after rotating the take-out member at the faster circumferential speed.

17. The method of claim 16, wherein in the take-out step, a speed pattern stored in advance in a storage portion is read out, and the take-out member is rotated in accordance with this speed pattern.

18. The method of claim 16, further comprising:

detecting an adsorption timing at which the take-out member adsorbs the sheet at the take-out position; and correcting a circumferential speed of the take-out member based on the detection result in the detecting step, after the sheet has been transferred to the conveyor portion until the next sheet is adsorbed, such that the next sheet is adsorbed at a predetermined adsorption timing.

19. The method of claim 16, further comprising:

controlling the circumferential speed of the take-out member such that an adsorption timing at which the take-out member adsorbs the sheet at the take-out position becomes a predetermined time interval.

20. The method of claim 16, further comprising:

controlling the circumferential speed of the take-out member such that a conveying pitch of the sheets in the conveyor portion becomes constant.

* * * * *